US005284170A

United States Patent [19]

Larsen

[11] Patent Number: 5,284,170

[45] Date of Patent: Feb. 8, 1994

[54] RECYCLABLE RINSER

[76] Inventor: Mark Larsen, 4431 S. Wenonah, Stickney, Ill. 60402

[21] Appl. No.: 865,932

[22] Filed: Apr. 9, 1992

[51] Int. Cl.[5] ..... B08B 3/02

[52] U.S. Cl. ..... 134/44; 134/52; 134/166 R; 134/201; 4/654; 4/638

[58] Field of Search ..... 134/44, 45, 46, 47, 134/48, 49, 50, 51, 52, 53, 54, 55, 172, 166 R, 201; 137/801; 4/654, 661, 638; 239/25, 26, 27

[56] References Cited

U.S. PATENT DOCUMENTS

| | | | |
|---|---|---|---|
| 82,650 | 9/1868 | Somers | 134/53 |
| 110,231 | 12/1870 | Hallowell | 134/55 |
| 358,219 | 2/1887 | Peter | 134/44 |
| 541,054 | 6/1895 | Pinostofte | 134/52 |
| 671,671 | 4/1901 | Horsley | 239/25 |
| 927,320 | 7/1909 | Blum | 134/44 |
| 1,406,030 | 2/1922 | Kelly | 4/638 |
| 1,524,484 | 1/1925 | Lutz | 239/25 |
| 1,527,135 | 2/1925 | Hepburn et al. . | |
| 1,585,317 | 5/1926 | Sievers | 134/44 X |
| 1,607,727 | 11/1926 | Dierson | 134/44 |
| 1,626,452 | 4/1927 | Cook | 134/52 X |
| 1,678,781 | 7/1928 | Ladd et al. | 134/52 X |
| 1,687,012 | 10/1928 | Forth | 134/44 |
| 1,789,440 | 1/1931 | Hyatt | 134/44 |
| 2,218,759 | 10/1940 | lineman . | |
| 2,570,635 | 10/1951 | Beyer, Jr. . | |
| 2,635,006 | 4/1953 | Richmond | 239/27 |
| 2,702,557 | 2/1955 | Wiskerchen | 134/52 |
| 2,749,715 | 6/1956 | Tice | 134/44 X |
| 2,790,632 | 4/1957 | Mellette . | |
| 3,101,174 | 8/1963 | Loveland . | |
| 3,265,082 | 8/1966 | Perlman | 239/25 X |
| 4,199,896 | 4/1980 | Lehman | 134/52 |
| 4,761,839 | 8/1988 | Ganaway . | |
| 4,991,775 | 2/1991 | Huber . | |
| 5,096,503 | 3/1992 | Wellman | 134/167 R X |

FOREIGN PATENT DOCUMENTS

| | | | |
|---|---|---|---|
| 20090 | of 1935 | Australia | 239/25 |
| 55-149463 | 11/1980 | Japan | 137/801 |
| 58-137678 | 8/1983 | Japan | 137/801 |
| 434040 | 8/1935 | United Kingdom | 239/25 |

*Primary Examiner*—Frankie L. Stinson
*Attorney, Agent, or Firm*—Hill, Steadman & Simpson

[57] ABSTRACT

A spraying device rinses recyclable or reusable containers by inverting the container over an open end of a rigid, tubular member. The rigid, tubular member is of substantially uniform diameter with openings of smaller diameter than the tubular member at its open end. A water stream flowing through the tubular member is controlled by hand-operation of a valve member or by valve actuation using the weight of the container and/or the pressure by a user holding the container which depresses a lever initiating the water stream. Therefore, either single-handed or two-handed operation for cleaning or rinsing containers may be performed.

10 Claims, 2 Drawing Sheets

RECYCLABLE RINSER

BACKGROUND OF THE INVENTION

The present invention generally relates to an apparatus for rinsing or spraying containers. More specifically, the invention relates to the cleaning of interior walls of recyclable or reusable containers, such as carbonated beverage bottles or cans, milk or juice cartons, baby jars, baby bottles, or any other container to be rinsed for recycling or reuse.

Generally, water faucets are designed for aerating water in a downward direction. To clean containers with a downwardly directed stream of water, it is necessary for a user to place the container under the stream of water such that the container collects water which in turn cleans the interior walls of the container. This requires a significant amount of water for rinsing and possibly requires scrubbing of the container by the user.

Spraying devices are also common which typically include an extendible tubing coming from a water source to a hand-operated spraying device such that water may be directed as desired by an operator of the device. Such a spraying device may be directed in any angular position as governed by the operator of the device.

Two prior art devices are known, such as in U.S. Pat. Nos. 2,570,635 and 3,101,174, which divert the normal downward stream of water to an upward stream. Each of the devices is particularly contemplated to be used as both a drinking fountain and as an ordinary faucet for drawing water by controlling a valve to direct the water stream appropriately.

SUMMARY OF THE INVENTION

The present invention provides an apparatus for directing a stream of water in an upward direction for rinsing, in particular, recyclable or reusable containers. The invention has a hook-shaped, rigid tubular member extending over a sink, a tub, a basin or other area where water can drain after the interior walls of the container have been sprayed with water.

In an embodiment, the invention provides an apparatus for attachment below a faucet handle which is separately mounted on a sink or counter top or a faucet handle which is mounted on a swivel above a spout. The faucet handle is hand-operated by a user which requires "two-handed cleaning." The user, with one hand, can hold the container to be rinsed in an inverted position such that its opening is above the open end of the hook-shaped tubular member from which water is sprayed. The tubular member is crimped at its open end such that a plurality of holes directs water upwardly to forcibly spray the interior of the container. The opposite end of the hook-shaped tubular member is attached below the hand-operated handle such that a valve is actuated to provide water to the tubular member.

In another embodiment, the invention provides a system for one-handed cleaning of a container by providing a valve activating member which extends a lever to a point near the output of the upwardly directed stream of water at the open end of the tubular member. One-handed operation is provided by the operator inverting the container over the open end of the tubular member such that the lever can be depressed by the weight of the container itself or pressure applied to the container by the operator when the operator loads the container over the open end of the tubular member.

In another embodiment, the tubular member is attached to one arm of a Y-member. The Y-member is typically used outdoors, but may be used at any location in which a threaded spout can attach to the Y-member. One leg of the Y-member has the hook-shaped tubular member connected thereto and the other leg may have an aerator, a hose, or other water diverting device. Each leg of the Y-member has its own on-off valve for controlling the water for streaming from an individual leg or both legs.

In another embodiment, the tubular member may be connected to the aerator of a spraying device such as a hand-operated spraying gun with an extendible tube found on many kitchen sinks. This allows for two-handed operation of cleaning of recyclable containers by the user over any portion of the sink. Therefore, if the sink has a divided basin, the extendible tube allows the cleaning to be performed over one or the other sections of the divided basin.

Additional features and advantages of the present invention are described, and will be apparent from, the detailed description of the presently preferred embodiments and from the drawings.

DESCRIPTION OF THE PREFERRED EMBODIMENTS

Figure 1:
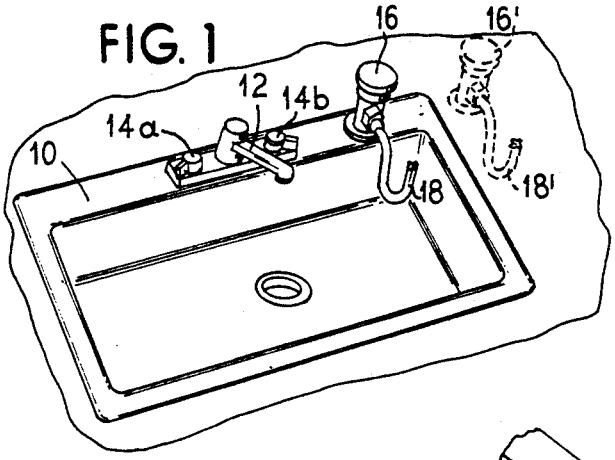
FIG. 1 is a side elevation of a faucet embodying the present invention showing the invention installed upon a sink.

In accordance with the invention, FIG. 1 shows a water basin or sink 10 upon which is mounted a faucet 12 having valve control handles **14*a* and 14*b*. A third handle 16 is mounted either on the sink 10 or an area near the sink 10, such as a counter top, as shown by the faucet handle 161 in FIG. 1. A hook-shaped member 18 is connected below the faucet handle 16** and sprays water in an upward direction from its open end.

Figure 2:
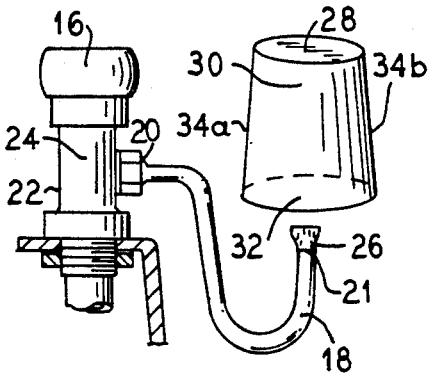
FIG. 2 is a sectional view of an embodiment of the present invention.

FIG. 2 shows an enlarged view of the hook-shaped tubular member 18. Both ends 20 and 21 of the tubular member 18 are threaded for a sealed connection to a pipe 22 encasing a valve member 24 controlled by the faucet handle 16 and connection to a spraying tip 26. The tubular member 18 can be made of a hard metallic material, such as steel or copper. The spraying tip 26 is threadably attached to the end 21 opposite the end 20 of the tubular member 18. The spraying tip 26 may be removed for replacing or cleaning as desired.

Figure 6A:
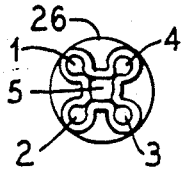
FIGS. 6A and 6B are enlarged views of the tip portion of the tubing member of the present invention.

FIG. 6A shows a top view of the spraying tip 26 of the tubular member 18. Five holes 1, 2, 3, 4 and 5 are shown. The diameters of each hole 1–5 are substantially equal in diameter and substantially smaller than the diameter of the tubular member 18. The diameter of hole 5 is slightly larger than holes 1–4. The holes 1–5 can be formed by crimping the spraying tip 26 of the tubular member 18. The holes 1–5 are arranged such that water can be diffused in a substantially vertical direction. Water, therefore, when activated by the faucet handle 16 is sprayed out of the spraying tip 26 to strike the closed end 28 of a container 30. The open end 32 is placed over the spraying tip 26 such that when the faucet handle 16 is turned to open the valve 24, water strikes the closed end 28 and the sides **34*a* and 34*b*. The water then freely falls into the sink 10 after striking the inside of the container 30 thereby rinsing the container 30**.

Figure 6B:
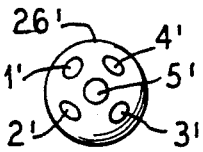

FIG. 6B shows an alternate embodiment for the spraying tip 26'. The tip 26' is slightly rounded with the opening 5' at the end point of the tip 26'. opening 5' again is slightly larger than the other openings 1', 2', 3' and 4'. The other openings 1', 2', 3' and 4' are slightly smaller in diameter than the opening 5'. The openings 1', 2', 3' and 4' are placed on the rounded portion of the tip 26' such that water being diffused from the spraying tip 26' through the openings 1', 2', 3' and 4' strikes the side walls **34*a* and 34*b* of the container 30. The point at which the side walls are struck depends on the size of the container 30 and the water pressure, as well as the placement of the container 30 over the spraying tip 26'. FIG. 6B illustrates the spraying tip 26' in which the holes 1', 2', 3' and 4' are equiangularly spaced about the spraying tip 26' in a direction different than the substantially upward direction of hole 5'**.

Figure 3:
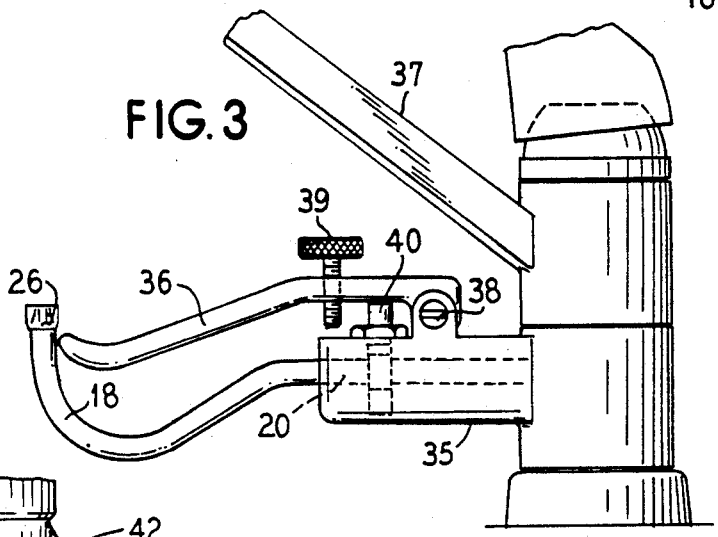
FIG. 3 is a sectional view of a second embodiment of the present invention using a lever for valve actuation.

FIG. 3 shows a unit 35 with a depressible lever 36 for valve actuation wherein the lever 36 is depressed by the weight of the container 30 and by pressure applied by a user holding the container 30. The unit 35 is attached directly beneath a spout 37 of a conventional water control and dispensing device. A roll pin hole 38 acts as a pivot point which the lever 36 may rotate. The roll pin hole 38 allows for a limited range of motion for the lever 36 to be depressed and then returned to its starting position after depression. The lever 36 depresses a valve member 40 such that when the valve member 40 is not depressed, no water may flow through the tubular member 18. When the lever 36 is depressed by a container 30 held by the user, the valve member 40 is likewise forced into a position wherein a water hole 42 is aligned with the threaded end 20 of the tubular member 18. This allows for water to flow through the tubular member 18 and through the spraying tip 26. Again, the spraying tip 26 may be threadably attached and may be formed either crimped as shown in FIG. 6A or with a rounded tip as shown in FIG. 6B. In addition, the unit 35 may rotate or swivel so that the spraying may occur over a particular sink when a double basin is used. Furthermore, a thumbscrew 39 may lock the lever 36 such that the lever 36 cannot actuate water flow when the thumbscrew 39 is locked. Inadvertent pressure applied to the lever 36 will, therefore, not result in actuation of water flow.

Figure 4:
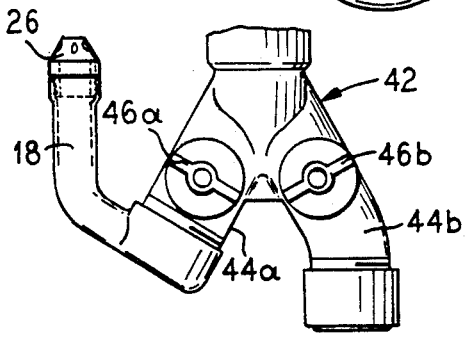
FIG. 4 is a sectional view of a Y-member as a connector for the present invention.

FIG. 4 shows another embodiment in which a Y-member 42 is used as a flow regulator and water diffuser. At least one of the legs **44*a* or 44*b* of the Y-member 42 has an attached tubular member 18 as shown in FIG. 3. The other leg may have attached thereto a standard aerating device, a hose, or other attachment, as desired. Two circular control valves 46*a* and 46*b* are located on each leg 44*a* and 44*b* of the Y-member 42. Each control valve 46*a* and 46*b* has an "on" and an "off" position which controls the flow of water through each leg 44*a* and 44*b* as desired. The tubular member 18 can be threadably attached or provided with a sealed end to be attached on the wall of one of the legs 44*a* or 44*b* of the Y-member 42. The spraying tip 26 of the tubular member 18 may have either of the tips as shown in FIGS. 6A and 6B and may be threadably attached to the tubular member 18**.

Figure 5:
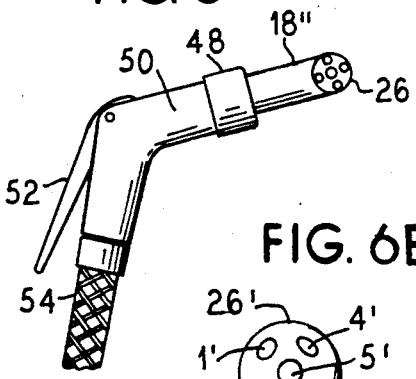
FIG. 5 is a sectional view of a hand-operated spraying device sealably connected to the present invention.

FIG. 5 shows the tubular member 18" snapped and sealed at the aerating end 48 of a standard spraying device 50. The spraying device 50 is hand-operated with a lever 52 as is well known in the art. In addition, an extendible tubing 54, generally below the level of a sink top of an ordinary kitchen sink, for example, can be used for manipulating the spraying device 50 by an operator to a convenient position for cleaning or rinsing a container.

Figure 7:
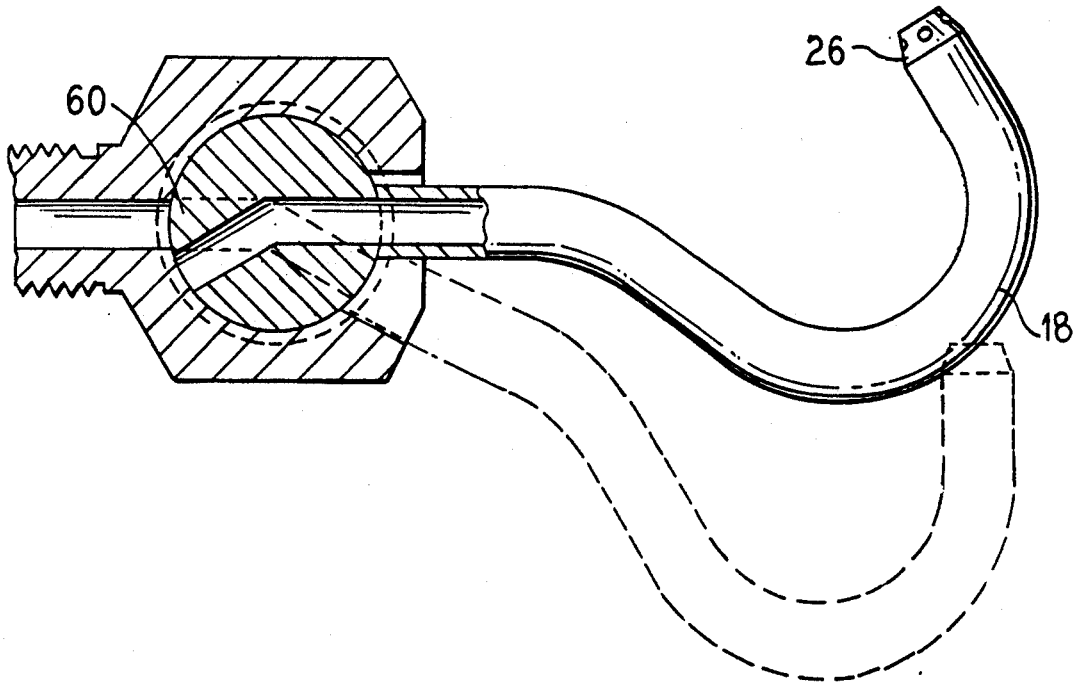
FIG. 7 is a sectional view of valve actuation using the tubular member as a lever.

FIG. 7 shows a variation of FIG. 2 wherein the hook-shaped tubular member 18 itself is depressible to actuate a water stream through a valve 60. When the tubular member 18 is in its normal locked position, the valve 60 is closed; however, when a container is placed over the tubular member 18, the weight of the container and/or the pressure applied by a user on the tubular member 18 forces the tubular member 18 to a lowered position to align the valve 60 in an open position.

It is contemplated that any container can be cleaned including reusable items, such as baby bottles or coffee cups, as well as recyclable items, such as carbonated beverage containers. Industrial usage for rinsing more difficult areas may be achieved using a higher pressure and a larger tubing than that described for residential use. Furthermore, both hot and cold water sources or combined warm water may be implemented as is well known in the art.

Although various minor changes and modifications might be proposed by those skilled in the art, it will be understood that I wish to include within the claims of the patent warranted hereon all such changes and modifications as reasonably come within my contribution to the art.

I claim as my invention:

1. A spraying device for rinsing a recyclable or reusable container having an interior bottom surface and interior walls projecting from said bottom surface, said device rotatably-fixed intermediate a basin top and a valve controller which regulates a flow of water from a water source, said device comprising:

a hook-shaped, rigid, tubular member of substantially uniform diameter having an inlet end for receiving said flow of water from said water source activated by said valve controller, a threaded end and an open end for directing a stream of water in an upward direction to individually rinse the entirety of said interior bottom surface and said interior walls of said container inverted above said open end; and a depressible lever for initiating said stream of water extending between a valve proximate to said threaded end of said tubular member and substantially adjacent proximity to said open end of said tubular member such that the weight of said inverted container held by a user and/or pressure applied to said container by said user on said lever at a point on said lever substantially adjacent said open end controls opening of said valve to initiate said water stream.

2. The device of claim 1 wherein said open end has a plurality of smaller openings of a smaller diameter than said tubular member, each of said plurality of smaller openings serving to direct said stream of water in a substantially upward direction.

3. The device of claim 2 wherein said plurality of smaller openings if five.

4. The device of claim 3 wherein said plurality of smaller openings comprises one larger, center opening with the remaining openings substantially equiangularly spaced about said center opening at a substantially equivalent radial distance from said center opening.

5. The device of claim 1 wherein said open end is rounded with a plurality of openings, each of said plurality of openings having a smaller diameter than said diameter of said tubular member.

6. The device of claim 1 wherein said plurality of openings is five including a center opening of a larger diameter than the remaining openings wherein the center opening is at the tip of said rounded open end.

7. The device of claim 1 further comprising:

means for locking said depressible lever in a locked position prohibiting initiation of said water stream.

8. The device of claim 1 wherein said open end is threadably attached to said tubular member.

9. The device of claim 1 wherein said valve is a pin having an open position and a sealed, closed position.

10. The device of claim 1 wherein said tubular member has a pivoting means at its threaded end such that when said tubular member is depressed by said container held by said user, said valve is pivoted to an open position initiating said water stream.

* * * * *